US011209021B2

(12) United States Patent
Nakaniwa et al.

(10) Patent No.: US 11,209,021 B2
(45) Date of Patent: Dec. 28, 2021

(54) CENTRIFUGAL ROTARY MACHINE

(71) Applicant: MITSUBISHI HEAVY INDUSTRIES COMPRESSOR CORPORATION, Tokyo (JP)

(72) Inventors: Akihiro Nakaniwa, Tokyo (JP); Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 21 days.

(21) Appl. No.: 16/075,892

(22) PCT Filed: Feb. 8, 2017

(86) PCT No.: PCT/JP2017/004577
§ 371 (c)(1),
(2) Date: Aug. 6, 2018

(87) PCT Pub. No.: WO2017/138563
PCT Pub. Date: Aug. 17, 2017

(65) Prior Publication Data

US 2019/0055962 A1 Feb. 21, 2019

(30) Foreign Application Priority Data

Feb. 8, 2016 (JP) ..... JP2016-021938

(51) Int. Cl.
*F04D 29/16* (2006.01)
*F04D 29/70* (2006.01)

(52) U.S. Cl.
CPC ..... *F04D 29/701* (2013.01); *F04D 29/161* (2013.01); *F04D 29/162* (2013.01); *F04D 29/167* (2013.01)

(58) Field of Classification Search
CPC .... F04D 29/161; F04D 29/162; F04D 29/167; F04D 29/701
See application file for complete search history.

(56) References Cited

U.S. PATENT DOCUMENTS 2,656,096 A * 10/1953 Schwarz ..... F04D 29/441 417/323
3,217,655 A * 11/1965 Sercy ..... F04D 15/00 415/116

(Continued)

FOREIGN PATENT DOCUMENTS

JP S63-106400 A 5/1988
JP S63-266199 A 11/1988

(Continued)

OTHER PUBLICATIONS

International Search Report for corresponding International Application No. PCT/JP2017/004577, dated Mar. 21, 2017 (3 pages).

(Continued)

*Primary Examiner* — Courtney D Heinle
*Assistant Examiner* — Andrew J Marien
(74) *Attorney, Agent, or Firm* — Osha Bergman Watanabe & Burton LLP

(57) ABSTRACT

This centrifugal rotary machine includes an impeller having a disk, blades, and a cover. The centrifugal rotary machine further includes a casing which accommodates the impeller radially inward and forms a gap between an outer circumferential surface of the cover and the casing. The centrifugal rotary machine further includes a sealing device which seals the gap. The casing includes an end wall surface which is disposed to face one axial side of a cover end surface facing one axial side of the cover, extends in the radial direction and forms a radial flow path between the end wall surface and the cover end surface. The casing further includes a (Continued)

foreign matter introduction path which is formed inside the casing and communicates with a radially outer side of the radial flow path.

8 Claims, 4 Drawing Sheets

(56) References Cited

U.S. PATENT DOCUMENTS 3,426,964 A * 2/1969 Silvern ..... F01D 17/143 415/49
3,612,713 A * 10/1971 Eggins ..... F03B 11/006 415/110
4,037,985 A * 7/1977 Karassik ..... F04D 29/167 415/175
4,981,018 A * 1/1991 Jones ..... F02C 3/08 415/143
5,201,801 A 4/1993 Smith, Jr.
6,699,008 B2 * 3/2004 Japikse ..... F04D 27/0207 415/144
7,025,557 B2 * 4/2006 Japikse ..... F01D 5/143 415/1
8,596,035 B2 * 12/2013 Mowill ..... F04D 27/0238 60/39.23
9,719,518 B2 * 8/2017 Mohtar ..... F04D 29/685
9,726,185 B2 * 8/2017 Chen ..... F04D 29/685
9,790,953 B2 * 10/2017 Kleynhans ..... F04D 29/284
10,280,932 B2 * 5/2019 Mei ..... F01D 11/06
10,400,788 B2 * 9/2019 Nakaniwa ..... F04D 17/122

FOREIGN PATENT DOCUMENTS

JP H05-156966 A 6/1993
JP H07-071398 A 3/1995

OTHER PUBLICATIONS

Written Opinion or corresponding International Application No. PCT/JP2017/004577, dated Mar. 21, 2017 (8 pages).

* cited by examiner

CENTRIFUGAL ROTARY MACHINE

TECHNICAL FIELD

The present invention relates to a centrifugal rotary machine.

Priority is claimed on Japanese Patent Application No. 2016-021938, filed Feb. 8, 2016, the content of which is incorporated herein by reference.

BACKGROUND ART

Generally, a centrifugal rotary machine has an impeller provided on a rotating shaft and a casing covering the impeller. When foreign matter particles such as dust or sand enter a space between the impeller and the casing while the impeller of the centrifugal rotary machine is rotating in the casing, the inside of the machine may be damaged.

For example, Patent Document 1 discloses a sizing apparatus which reduces an amount of foreign matter particles entering a compressor of a gas turbine engine, which is a type of rotary machine.

CITATION LIST

Patent Documents

[Patent Document 1]

Japanese Unexamined Patent Application, First Publication No. H5-156966

SUMMARY OF INVENTION

Technical Problem

In the case that foreign matter particles flow into a centrifugal rotary machine, when the foreign matter particles come into contact with the rotating impeller, the foreign particles are ejected to the side outward from the impeller in a radial direction and stay between the impeller and the casing. The foreign matter particles staying between the impeller and the casing may cause wear on the inside of the centrifugal rotary machine or may damage the inside of the centrifugal rotary machine.

The present invention provides a centrifugal rotary machine capable of removing foreign matter particles flowing to an impeller of the centrifugal rotary machine.

Solution to Problem

According to a first aspect of the present invention, a centrifugal rotary machine includes an impeller, a casing and a sealing device. The impeller includes a disk, blades, and a cover. The disk has a disk shape which rotates around an axis thereof. The blades define and form flow paths extending from one side in the axial direction toward a radial outer side between each other by being provided at intervals in a circumferential direction on a surface facing one side in the axial direction of the disk. The cover covers the blades from a side radially outward therefrom. The casing accommodates the impeller radially inside thereof and forms a gap between the casing and an outer circumferential surface of the cover. The sealing device seals the gap. The casing includes an end wall surface and a foreign matter introduction path. The end wall surface is disposed to face one side in the axial direction of a cover end surface facing one side in the axial direction of the cover, extends in the radial direction and forms a radial flow path between the end wall surface and the cover end surface. The foreign matter introduction path is formed inside the casing and communicates with a radial outer side of the radial flow path.

In the centrifugal rotary machine of the aspect, when foreign matter particles flow into the impeller, the foreign particles are ejected outward in the radial direction by the impeller, and further since the foreign matter particles enter the foreign matter introduction path, the foreign matter particles can be removed from the gap between the impeller and the casing.

According to a second aspect of the present invention, in the centrifugal rotary machine according to the first aspect, an inner dimension of the foreign matter introduction path in an axial direction of the disk may be equal to or larger than an inner dimension of the radial flow path in a axial direction of the disk.

In this case, since a flow velocity in the foreign matter introduction path is lower than a flow velocity in the radial flow path during an operation of the centrifugal rotary machine, the foreign matter particles can be captured in the foreign matter introduction path.

According to a third aspect of the present invention, in the centrifugal rotary machine according to the first or second aspect, the foreign matter introduction path may be inclined and extend to face a front of the disk in a rotation direction going toward a radial outer side of the disk when seen in the axial direction of the disk.

In this case, since the foreign matter introduction path extends in a direction in which the foreign matter particles are moved by rotation of the impeller, it is possible for the foreign matter particles to enter the foreign matter introduction path smoothly.

According to a fourth aspect of the present invention, in the centrifugal rotary machine according to any one of the first to third aspects, the casing may further include a foreign matter storage portion which communicates with a radial outer side of the foreign matter introduction path and forms an annular space centering on an axis of the disk.

In this case, since the foreign matter particles are accommodated in the foreign matter storage portion, it is possible to inhibit returning of the foreign matter particles which have entered the foreign matter introduction path.

According to a fifth aspect of the present invention, in the centrifugal rotary machine according to the fourth aspect, the sealing device may be connected to the casing and disposed in the gap with a predetermined clearance with respect to the cover. An area of the foreign matter storage portion when seen in a direction of the axis of the disk may be equal to or larger than 10 times an area of the annular space defined by the clearance between the sealing device and the cover when seen in the direction of the axis of the disk.

In this case, since the flow velocity in the vicinity of the sealing device is lower than the flow velocity in the foreign matter storage portion during the operation of the centrifugal rotating machine, it is difficult for the foreign matter particles to stay in the vicinity of the sealing device, and the foreign matter particles can be captured in the foreign matter storage portion.

According to a sixth aspect of the present invention, in the centrifugal rotary machine according to the fourth aspect, the casing may further include a foreign matter discharge path which communicates with a radial outer side of the foreign matter storage portion, and a valve which switches the foreign matter discharge path between being open and closed.

In this case, it is possible to easily discharge the foreign matter particles in the foreign matter storage portion outside. Further, in this case, it is possible to easily discharge the foreign matter particles due to an air current generated in the foreign matter storage portion by opening the valve during the operation of the centrifugal rotary machine.

According to a seventh aspect of the present invention, in the centrifugal rotary machine according to the sixth aspect, the foreign matter discharge path may be inclined and extend to face a front of the disk in a rotation direction going toward a radial outer side of the disk when seen in the direction of the axis of the disk.

In this case, since the foreign matter discharge path extends in a direction in which the foreign matter particles are moved by the rotation of the impeller, the foreign matter particles can smoothly enter the inside of the foreign matter discharge path.

Advantageous Effects of Invention

According to the above-described centrifugal rotary machine, it is possible to remove the foreign matter particles flowing to the impeller.

DESCRIPTION OF EMBODIMENTS

Figure 1:
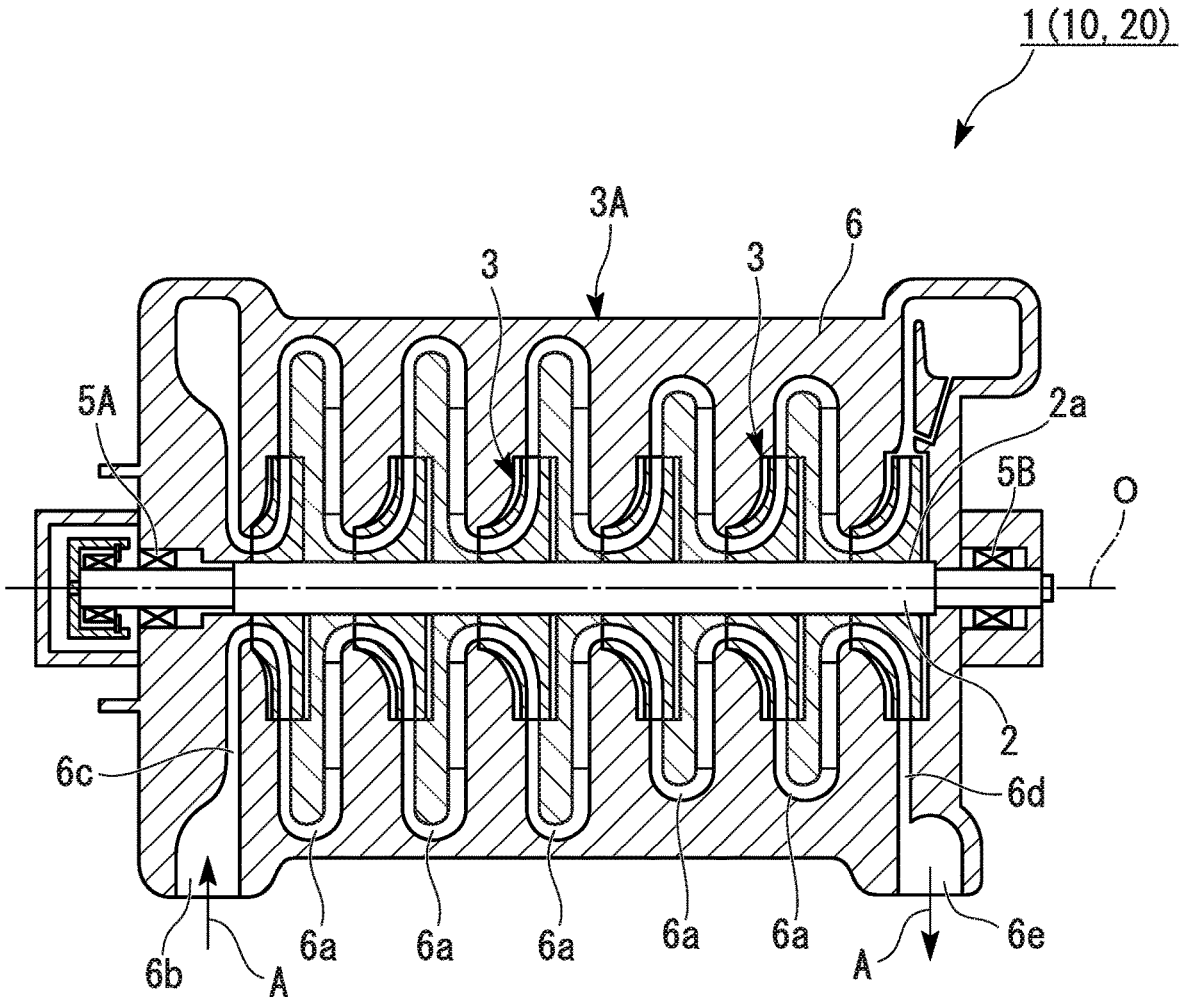
FIG. 1 is a cross-sectional view showing a schematic constitution of a centrifugal rotary machine according to a first embodiment of the present invention.

Hereinafter, embodiments to which the present invention is applied will be described in detail with reference to the drawings. The drawings used in the following description are for illustrating the constitution of the embodiment of the present invention, but the sizes, thicknesses, dimensions, and so on of the respective parts shown in the drawings may be different from those in dimensional relationships in actual centrifugal rotary machines and sealing devices.

First Embodiment

Figure 2:
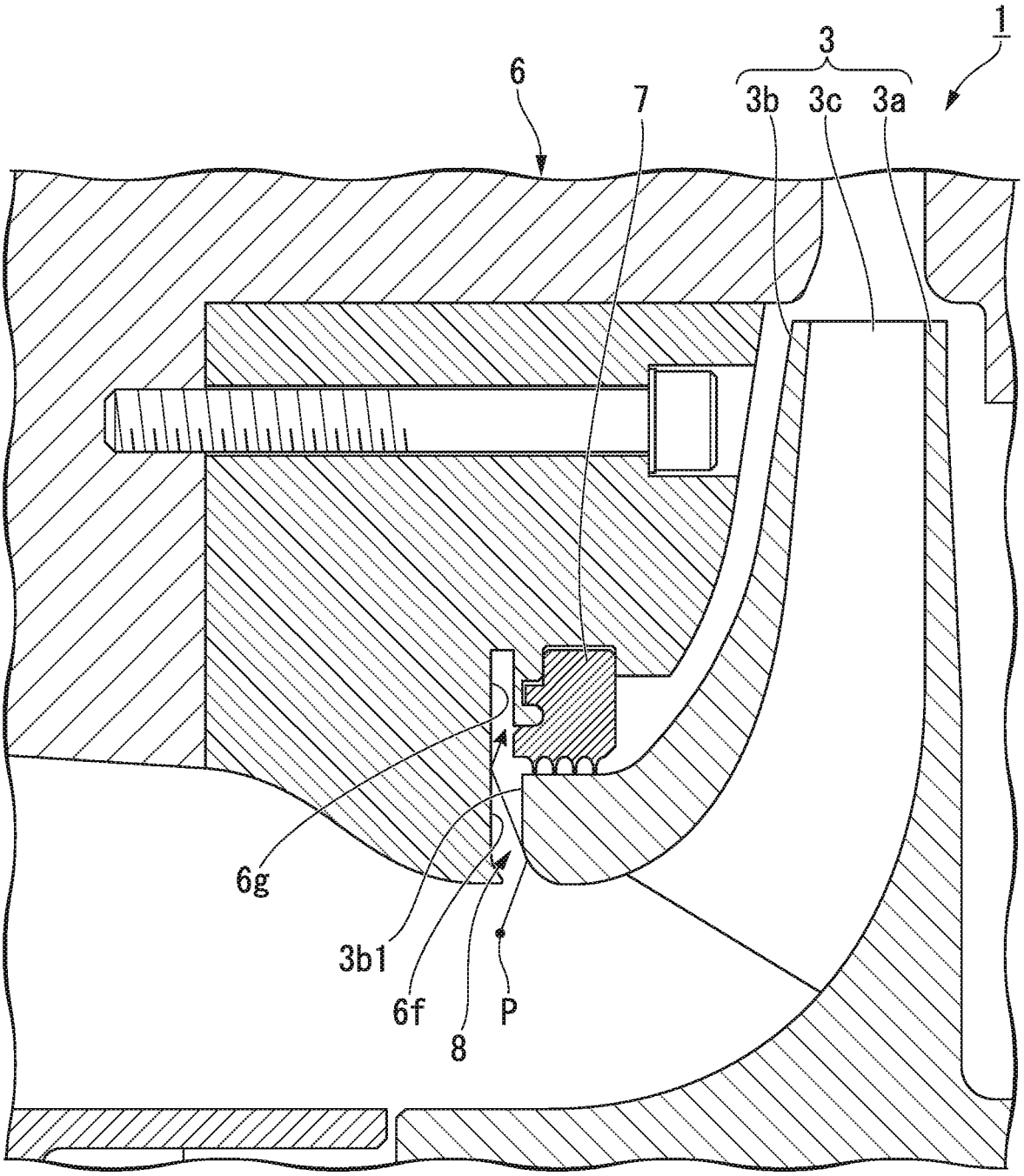
FIG. 2 is an enlarged view of the impeller of FIG. 1.

A first embodiment of the present invention will be described. FIG. 1 is a cross-sectional view showing a schematic constitution of a centrifugal rotary machine according to a first embodiment of the present invention. FIG. 2 is an enlarged view of FIG. 1. FIG. 1 shows a cross section in the case in which the centrifugal rotary machine 1 is cut such that a rotating shaft 2 of the centrifugal rotary machine 1 is divided into two by a virtual plane parallel to an extending direction of the rotating shaft 2.

In FIG. 1, A indicates a moving direction of a fluid (for example, process gas), and O indicates an axis of the rotating shaft 2.

Referring to FIGS. 1 and 2, the centrifugal rotary machine 1 of the embodiment includes the rotating shaft 2, an impeller 3, a pair of bearings 5A and 5B, a casing 6, and a sealing device 7.

The rotating shaft 2 is a columnar member extending in the same direction as a direction (axial direction) in which the axis O extends. Both ends (first end and second end) of the rotating shaft 2 located in the direction in which the axis O extends are rotatably supported by the bearings 5A and 5B. The rotating shaft 2 rotates in one direction. The rotating shaft 2 has an outer circumferential surface 2*a* formed into a curved surface.

The impeller 3 is provided on the outer circumferential surface 2*a* of the rotating shaft 2 located between the bearing 5A and the bearing 5B. The impeller 3 has a disk 3*a*, a cover 3*b*, and a plurality of blades 3*c*.

The disk 3*a* is provided so that a diameter thereof gradually increases outward in the radial direction of the rotating shaft 2 going from one end (first end) of the rotating shaft 2 to the other end (second end) thereof in the axial direction. A shape of the disk 3*a* can be, for example, a disc-shape. An axis of the disk 3*a* is located on the axis O of the rotating shaft 2. Hereinafter, the axis of the disk 3*a* is also referred to as "axis O."

The cover 3*b* is provided to face the disk 3*a*. The cover 3*b* covers the plurality of blades 3*c*.

The plurality of blades 3*c* are radially provided on the side outward from the disk 3*a* to be spaced apart from the disk 3*a*. The blades 3*c* define and form a flow path extending from one side (first end side) of the disk 3*a* in the axial direction to the outer side thereof in the radial direction.

In the embodiment, a multi-stage impeller group 3A is constituted by a plurality of impellers 3 arranged in the axial direction.

The bearing 5A rotatably supports one end (first end) of the rotating shaft 2. The bearing 5B rotatably supports the other end (the second end) of the rotating shaft 2.

A casing 6 has a cylindrical shape and supports the bearings 5A and 5B from the outside. The casing 6 accommodates the rotating shaft 2, the impeller 3, and the sealing device 7 radial inside thereof.

The casing 6 is constituted to rotate the rotating shaft 2 and the impeller 3 with respect to the casing 6.

The casing 6 has a casing flow path 6*a*, a suction port 6*b*, connection flow paths 6*c* and 6*d*, and a discharge port 6*e*. The casing flow path 6*a*, the suction port 6*b*, the connection flow paths 6*c* and 6*d*, and the discharge port 6*e* are provided in a portion of the casing 6 corresponding to a region in which the multi-stage impeller group 3A is disposed.

The casing 6 has an end wall surface 6*f* and a foreign matter introduction path 6*g*. The end wall surface 6*f* and the foreign matter introduction path 6*g* are provided with respect to each of the impellers 3 constituting the multi-stage impeller group 3A.

The casing flow path 6*a* is formed inside the casing 6 and connects the flow paths of impellers 3 adjacent in the axial direction. The casing flow path 6*a* is formed in an annular shape around the axis O in the casing 6 located outward from the rotating shaft 2.

The suction port 6*b* is provided in the casing 6 located on the side close to the bearing 5A. The suction port 6*b* suctions a fluid A and guides the suctioned fluid A to the casing flow path 6*a* via the connection flow path 6*c*.

The connection flow path 6*c* is formed in the casing 6 and connects the casing flow path 6*a* to the suction port 6*b*.

The connection flow path 6*d* is formed in the casing 6 and connects the discharge port 6*e* and the casing flow path 6*a*.

The discharge port 6*e* discharges the fluid A passing through the connection flow path 6*d* outside of the casing 6.

The end wall surface 6*f* is disposed to face a cover end surface 3*b*1 facing one side in the axial direction of the cover 3*b* and extends in the radial direction. The end wall surface 6*f* is disposed on one side in the axial direction with respect to the cover end surface 3*b*1. The end wall surface 6*f* forms a radial flow path 8 between the end wall surface 6*f* and the cover end surface 3*b*1.

The radial flow path 8 is a flow path into which foreign matter particles P contained in the fluid A introduced during an operation of the centrifugal rotary machine 1 can enter. The foreign matter particles P which have entered the radial flow path 8 come into contact with the cover 3*b* of the rotating impeller 3 and move radially outward from the impeller 3.

A foreign matter introduction path 6*g* is formed in the casing 6. The foreign matter introduction path 6*g* is formed radially outside the radial flow path 8 and communicates with the radial flow path 8. The foreign matter introduction path 6*g* is a path which moves the foreign matter particles P to the side radially outward from the sealing device 7. The foreign matter introduction path 6*g* according to the embodiment allows the foreign matter particles P moved to the vicinity of the sealing device 7 through the radial flow path 8 to move radially outward from the sealing device 7. Therefore, it is possible to prevent the foreign matter particles P from staying in the vicinity of the sealing device 7. That is, since the foreign matter introduction path 6*g* is provided in the casing 6, the foreign matter particles P can be removed from a gap between the impeller 3 and the casing 6.

In the embodiment, the foreign matter introduction path 6*g* is provided at least at one position in the circumferential direction of the disk 3*a*. The foreign matter introduction path 6*g* in the embodiment may be located below the impeller 3 in a state in which the centrifugal rotary machine 1 is installed so that the rotating shaft 2 is horizontal. In this case, since the foreign matter particles P in the foreign matter introduction path 6*g* stay in the foreign matter introduction path 6*g* due to gravity, it is difficult for the foreign matter particles P to return to the impeller 3 side.

An inner dimension of the foreign matter introduction path 6*g* in the direction of the axis O of the disk 3*a* is equal to or larger than an inner dimension of the radial flow path 8 in the axial direction of the disk 3*a*. Therefore, a flow velocity of the fluid A flowing from the radial flow path 8 to the foreign matter introduction path 6*g* is reduced in the foreign matter introduction path 6*g*. Accordingly, the foreign matter particles P which have entered the foreign matter introduction path 6*g* stay in the foreign matter introduction path 6*g*. As a result, it is possible to quickly remove the foreign matter particles P from the gap between the impeller 3 and the casing 6 and to make it difficult for the foreign matter particles P to return from the foreign matter introduction path 6*g* to the sealing device 7 side.

The foreign matter introduction path 6*g* is inclined and extends toward the front of the disk 3*a* in the rotation direction and toward the radially outer side of the disk 3*a* when seen in the axial direction of the disk 3*a*. Therefore, when the foreign matter particles P collide with the rotating cover 3*b* while the impeller 3 is rotating, the foreign matter particles P smoothly enter the foreign matter introduction path 6*g*.

As shown in FIG. 2, the sealing device 7 is disposed in the gap between the impeller 3 and the casing 6. The sealing device 7 of the embodiment is a so-called labyrinth seal. The sealing device 7 seals the gap between the impeller 3 and the casing 6 in a state in which the sealing device 7 has a predetermined clearance with respect to the cover 3*b* of the impeller 3. The sealing device 7 is connected to the casing 6.

An operation of the centrifugal rotary machine 1 of the embodiment will be described.

During the operation of the centrifugal rotary machine 1 of the embodiment, the foreign matter particles P in the fluid A move to the foreign matter introduction path 6*g*, and thus staying of the foreign particles P in the vicinity of the sealing device 7 can be inhibited. Therefore, it is possible to prevent the foreign matter particles P from entering between the sealing device 7 and the cover 3*b* and thereby breaking the sealing device 7 or causing wear to the cover 3*b*. Further, according to the centrifugal rotary machine 1 of the embodiment, since the foreign matter particles P can be removed from the gap between the impeller 3 and the casing 6, damage due to the foreign matter particles P colliding with the casing 6, the impeller 3, or the like is unlikely to occur.

Second Embodiment

Figure 3:
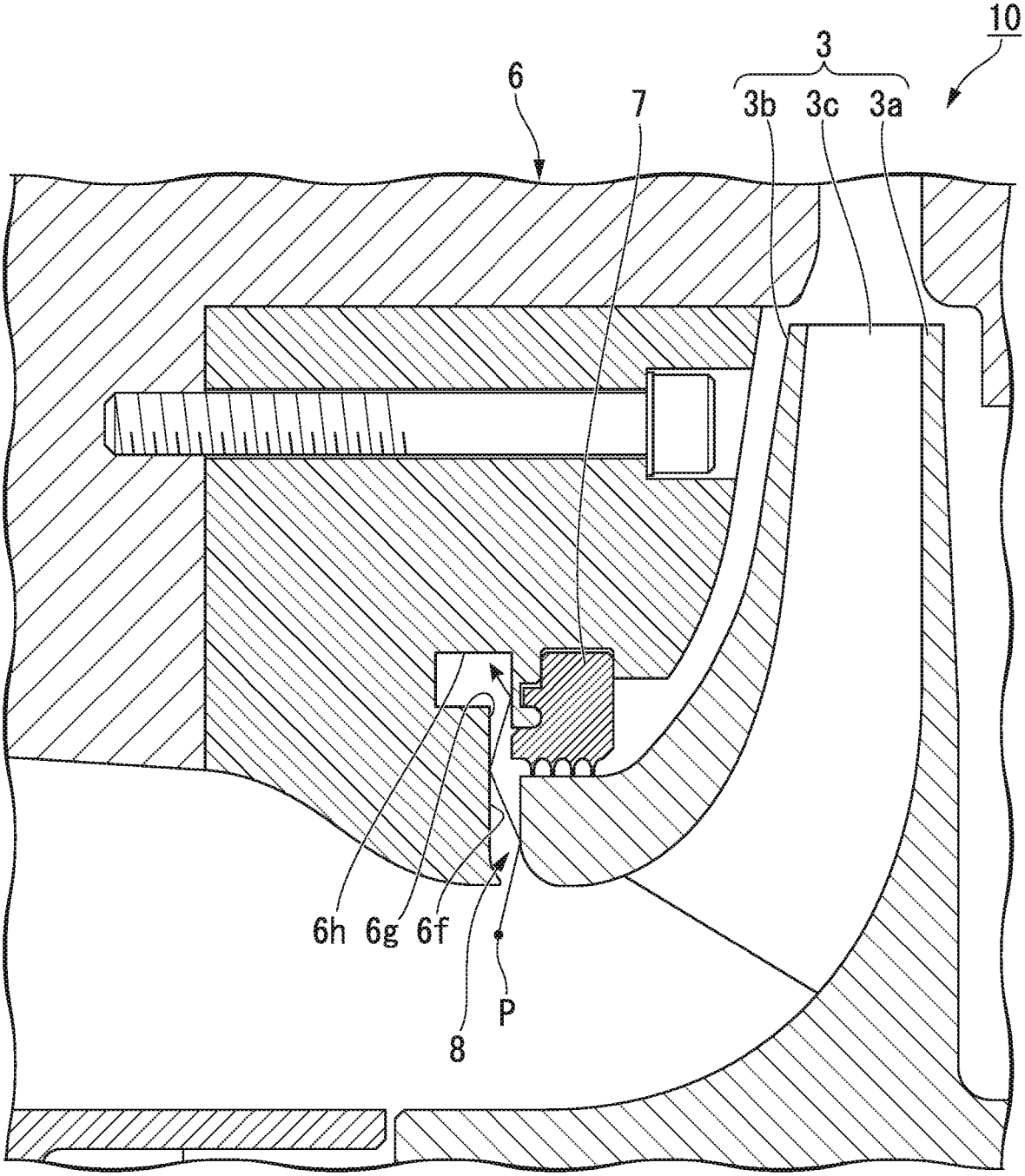
FIG. 3 is an enlarged cross-sectional view of an impeller of a centrifugal rotary machine according to a second embodiment of the present invention.
Figure 4:
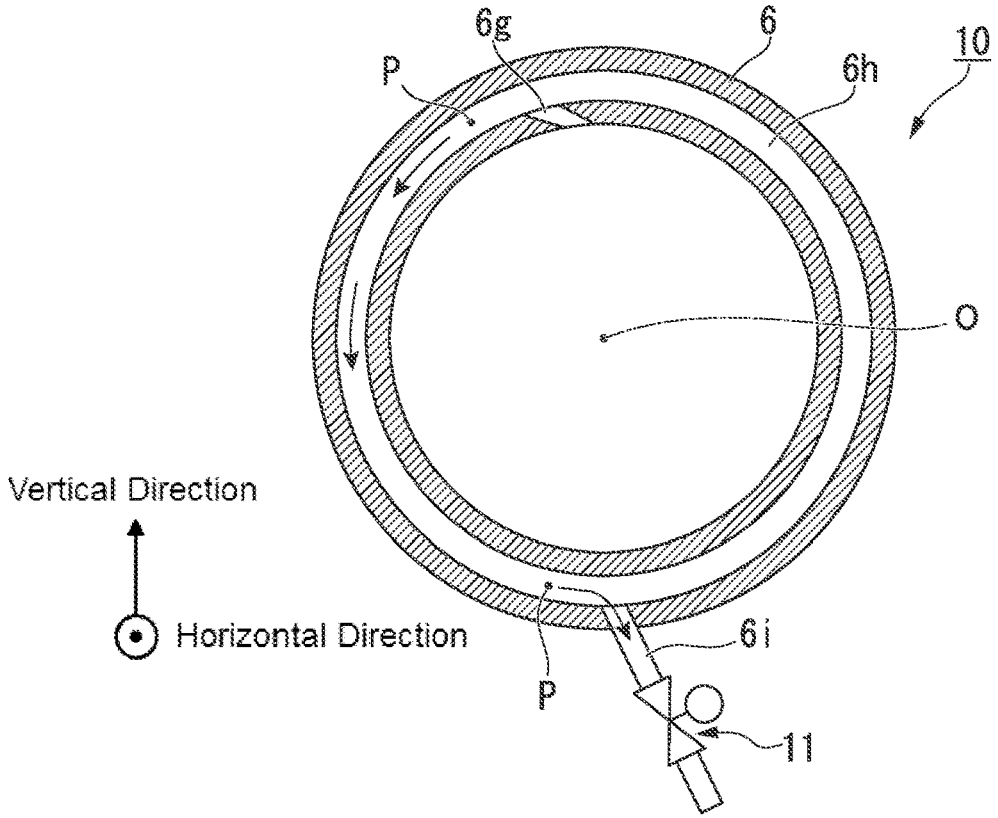
FIG. 4 is a cross-sectional view showing a schematic constitution of the centrifugal rotary machine according to the second embodiment of the present invention when seen in an axial direction of a disk.

A second embodiment of the present invention will be described. FIG. 3 is an enlarged cross-sectional view of a centrifugal rotary machine according to the present embodiment. FIG. 4 is a cross-sectional view showing a schematic constitution of the centrifugal rotary machine as seen in the axial direction of the disk.

A centrifugal rotary machine 10 of the embodiment shown in FIGS. 3 and 4 is different from that of the first embodiment in that the casing 6 has a foreign matter storage portion 6*h*, a foreign matter discharge path 6*i*, and a valve 11.

The foreign matter storage portion 6*h* is disposed radially outward from the foreign matter introduction path 6*g* and communicates with the foreign matter introduction path 6*g*. The foreign matter storage portion 6*h* is formed by the casing 6 to form an annular space centering on the axis O of the disk 3*a*.

An area of the foreign matter storage portion 6*h* when seen in the direction of the axis O of the disk 3*a* is equal to or larger than 10 times an area of the annular space defined by the clearance between the sealing device 7 and the cover 3*b* when seen in the direction of the axis O of the disk 3*a*. Therefore, the flow velocity in the foreign matter storage portion 6*h* is sufficiently lower than the flow velocity in the vicinity of the sealing device 7, and thus the foreign matter particles P can be captured in the foreign matter storage portion 6*h*.

The foreign matter discharge path 6*i* is disposed radially outward from the foreign matter storage portion 6*h* and communicates with the foreign matter storage portion 6*h*. The foreign matter discharge path 6*i* is a path into which the foreign matter particles P moving along the outer circumferential side inner surface of the foreign matter storage portion 6*h* can enter.

The foreign matter discharge path 6*i* is inclined and extends toward the front of the disk 3*a* in the rotation direction and outward in the radial direction of the disk 3*a* when seen in the direction of the axis O of the disk 3*a*.

The foreign matter discharge path 6*i* in the embodiment may be located below the foreign matter storage portion 6*h* in a state in which the centrifugal rotary machine 1 is installed so that the rotating shaft 2 is horizontal. In this case, since the foreign matter particles P in the foreign matter storage portion 6*h* stay in the foreign matter discharge path 6*i* due to gravity, it is difficult for the foreign matter particles P to return to the impeller 3 side.

The foreign matter introduction path 6*g* may be located above the impeller 3 in a state in which the centrifugal rotary machine 1 is installed so that the rotating shaft 2 is horizontal. In this case, since the foreign matter particles P captured in the foreign matter storage portion 6*h* through the foreign matter introduction path 6*g* fall by gravity and are separated from the foreign matter introduction path 6*g*, it is possible to prevent the foreign matter particles P from flowing back into the foreign matter introduction path 6*g* and returning to the impeller 3 side.

The valve 11 can switch between open/closed states of the foreign matter discharge path 6*i*. The valve 11 can be opened or closed manually or electrically. In a state in which the valve 11 is open, the foreign matter particles P which have moved from the foreign matter storage portion 6*h* to the foreign matter discharge path 6*i* are discharged to the outside of the centrifugal rotary machine 10. The discharging of the foreign matter particles P through the valve 11 is possible also during the operation of the centrifugal rotary machine 10. In this case, the foreign matter particles P can be placed in the flow of the fluid A flowing through the foreign matter introduction path 6*g* by rotating the impeller 3, and thus the foreign matter particles P can be actively delivered to the foreign matter discharge path 6*i*. Therefore, the foreign matter particles P can be promptly discharged to the outside of the centrifugal rotary machine 10.

The operation of the centrifugal rotary machine 10 of the embodiment will be described.

In the embodiment, the foreign matter particles P which have entered the foreign matter introduction path 6*g* are captured in the foreign matter storage portion 6*h*, and thus it is difficult for the foreign matter particles P to return to the sealing device 7 side. Further, the foreign matter particles P captured in the foreign matter storage portion 6*h* can be discharged to the outside of the centrifugal rotary machine 10 through the foreign matter discharge path 6*i*.

Third Embodiment

Figure 5:
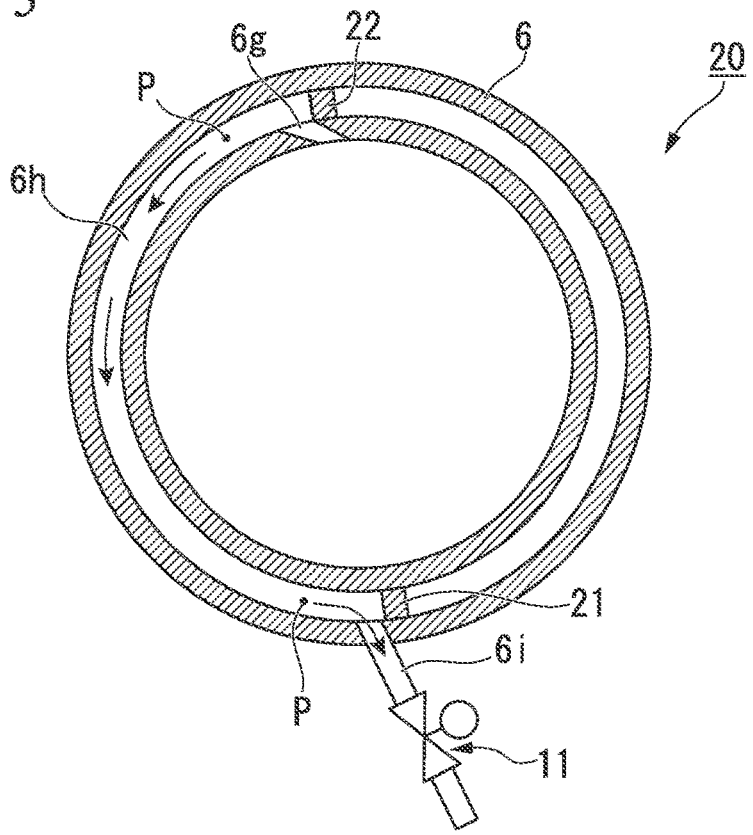
FIG. 5 is a cross-sectional view showing a schematic constitution of a centrifugal rotary machine according to a third embodiment of the present invention when seen in an axial direction of a disk.

A third embodiment of the present invention will be described. FIG. 5 is a cross-sectional view showing a schematic constitution of the centrifugal rotary machine according to the embodiment when seen in the axial direction of the disk.

The casing 6 of the centrifugal rotary machine 20 of the embodiment shown in FIG. 5 further includes a first partition wall 21 and a second partition wall 22 in addition to the constituents of the second embodiment.

The first partition wall 21 blocks the foreign matter particles P in the foreign matter storage portion 6*h* and guides them to the foreign matter discharge path 6*i*.

The second partition wall 22 is disposed in the foreign matter storage portion 6*h* to restrict the moving path of the foreign matter particles P between the foreign matter introduction path 6*g* and the foreign matter discharge path 6*i*.

Due to the provision of the first partition wall 21, the foreign matter particles P which have entered the foreign matter storage portion 6*h* are prevented from continuously moving in the rotation direction of the rotating impeller 3 (for example, forward in the rotation direction). The foreign matter particles P which have entered the foreign matter storage portion 6*h* collide with the first partition wall 21 and enter the foreign matter discharge path 6*i*.

Due to the provision of the second partition walls 22, the foreign matter particles P which have entered the foreign matter storage portion 6*h* are prevented from moving in a direction opposite to the rotating direction of the rotating impeller 3 (backward in the rotational direction). The foreign matter particles P can be prevented from staying at a position opposite to the foreign matter discharge path 6*i* (in the foreign matter storage portion 6*h*) with the first partition wall 21 interposed therebetween in the circumferential direction of the disk 3*a* when seen in the axial direction of the disk 3*a*.

Although the embodiments of the present invention have been described in detail with reference to the drawings, specific constitutions are not limited to these embodiments, and design changes and the like within the scope not deviating from the gist of the present invention are included.

For example, in the first embodiment, the foreign matter introduction path 6*g* may be provided at two or more places in the circumferential direction of the disk 3*a*.

The foreign matter introduction path 6*g* may have a slit shape extending continuously in the circumferential direction of the disk 3*a* (for example, continuous over one entire revolution).

INDUSTRIAL APPLICABILITY

The present invention is applicable to a centrifugal rotary machine. According to this centrifugal rotary machine, it is possible to remove foreign matter particles flowing into the impeller.

REFERENCE SIGNS LIST

1, 10, 20 Centrifugal rotary machine
2 Rotating shaft
2*a* Outer circumferential surface
3 Impeller
3*a* Disk
3A Multi-stage impeller group
3*b* Cover
3*b*1 Cover end surface
3*c* Blade
5A Bearing
5B Bearing
6 Casing
6*a* Casing flow path
6*b* Suction port
6*c* Connection flow path
6*d* Connection flow path
6*e* Discharge port
6*f* End wall surface
6*g* Foreign matter introduction path
6*h* Foreign matter storage portion
6*i* Foreign matter discharge path
7 Sealing device
8 Radial flow path
10 Centrifugal rotary machine
11 Valve
20 Centrifugal rotary machine
21 First partition wall
22 Second partition wall
P Foreign matter particles

The invention claimed is:

1. A centrifugal rotary machine comprising:

an impeller including a disk formed to have a disc-shape which rotates around an axis, blades which define and form a flow path extending from one axial side toward a radially outer side between each other by being provided at intervals in a circumferential direction on a surface facing one axial side of the disk, and a cover which covers the blades from a radially outer side;

a casing which accommodates the impeller radially inward and forms a gap between the casing and an outer circumferential surface of the cover; and a sealing device which seals the gap, wherein the casing includes an end wall surface which is disposed to face one axial side of a cover end surface facing one axial side of the cover, extends in a radial direction and forms a radial flow path between the end wall surface and the cover end surface, a foreign matter introduction path which is formed inside the casing and communicates with a radially outer side of the radial flow path, a foreign matter storage portion which communicates with a radially outer side of the foreign matter introduction path and forms an annular space centering on an axis of the disk, and a foreign matter discharge path which communicates with a radially outer side of the foreign matter storage portion, and wherein the foreign matter introduction path extends radially outward while inclining with respect to the radial direction toward a rotation direction of the disk when seen in an axial direction of the disk, wherein the foreign matter introduction path is located above the impeller in a state in which the axis of the disk is horizontal, and wherein the foreign matter discharge path is located below the foreign matter storage portion in a state in which the axis of the disk is horizontal.

2. The centrifugal rotary machine according to claim 1, wherein an inner dimension of the foreign matter introduction path in the axial direction of the disk is equal to or larger than an inner dimension of the radial flow path in the axial direction of the disk.

3. The centrifugal rotary machine according to claim 1, wherein the sealing device is connected to the casing and disposed in the gap with a predetermined clearance with respect to the cover, and an area of the foreign matter storage portion when seen in a direction of the axis of the disk is equal to or larger than 10 times an area of the annular space defined by the clearance between the sealing device and the cover when seen in the direction of the axis of the disk.

4. The centrifugal rotary machine according to claim 1, wherein the casing further includes a valve which switches opening and closing of the foreign matter discharge path.

5. The centrifugal rotary machine according to claim 4, wherein the foreign matter discharge path is inclined and extends to face a front of the disk in a rotation direction going toward a radially outer side of the disk when seen in the direction of the axis of the disk.

6. The centrifugal rotary machine according to claim 2, wherein the sealing device is connected to the casing and disposed in the gap with a predetermined clearance with respect to the cover, and an area of the foreign matter storage portion when seen in a direction of the axis of the disk is equal to or larger than 10 times an area of the annular space defined by the clearance between the sealing device and the cover when seen in the direction of the axis of the disk.

7. The centrifugal rotary machine according to claim 2, wherein the casing further includes a valve which switches opening and closing of the foreign matter discharge path.

8. The centrifugal rotary machine according to claim 7, wherein the foreign matter discharge path is inclined and extends to face a front of the disk in a rotation direction going toward a radially outer side of the disk when seen in the direction of the axis of the disk.

* * * * *